United States Patent [19]

McMahon

[11] Patent Number: 5,067,922

[45] Date of Patent: Nov. 26, 1991

[54] COMBINATION DRINK COOLER AND THROWING TOY

[76] Inventor: Michael E. McMahon, 1175 Glen Cyn. Rd., Scotts Valley, Calif. 95066

[21] Appl. No.: 510,967

[22] Filed: Apr. 19, 1990

[51] Int. Cl.[5] ..... A63H 27/00; B65D 23/08

[52] U.S. Cl. ..... 446/71; 446/61; 215/13.1; 220/903

[58] Field of Search ..... 446/34, 61, 46, 48, 446/71, 77; 215/12.1, 12.2, 13.1; 220/408, 903; 273/428, 425, 424; D21/82, 85, 86

[56] References Cited

U.S. PATENT DOCUMENTS

| | | | |
|---|---|---|---|
| D. 270,076 | 8/1983 | Jeter | D21/82 |
| 3,982,489 | 9/1976 | Flatau et al. | 446/34 X |
| 4,246,721 | 1/1981 | Bowers | 446/61 X |
| 4,708,254 | 11/1987 | Byrns | 215/13.1 |

*Primary Examiner*—Mickey Yu

[57] ABSTRACT

An insulating device for keeping a container of liquid from losing its thermal content to its environment that can double as a recreational throwing toy. The device is constructed of two open-ended cylinder bodies, one inside the other. The inner cylinder 8 of an insulating material for the purpose of keeping a container of liquid cold (or warm) is adhered to the inner side of the outer cylinder 10 of a stiff, yet flexible plastic composite that provides aerodynamic stability and durability. A uniformly weighted ring 2 encircles the forward end of the device sandwiched between the two cylinders, thus providing a forward center of gravity that produces stability in flight. The forward edge 6 of the device is rounded for durability and aerodynamics, while the rear edge 4 is rounded and slightly tapered to reduce drag while in flight. The device, when propelled through the air and provided with a rotation about its horizontal axis will fly in a smooth and calculatable manner. The device, when slipped over a cylindrical beverage container will provide an insulating property for keeping the liquid within at a desirable temperature.

7 Claims, 2 Drawing Sheets

COMBINATION DRINK COOLER AND THROWING TOY

BACKGROUND—FIELD OF INVENTION

This invention relates to amusement devices and beverage containers. Amusement devices that can be used not only for recreation as a throwing toy, but can serve a dual purpose as a functional device for keeping a container of liquid insulated.

BACKGROUND—DESCRIPTION OF PRIOR ART

Most consumers are familiar with the functionality and practicality of the common drink cooler (insulator). An insulating device for keeping a container of liquid cold. Many trained in the field of aerodynamics are aware of the flying characteristics and aerodynamic qualities of the flying cylinder concept.

Heretofore these devices were used and enjoyed separately for their individual purposes and characteristics.

The typical drink cooler consisting of an insulating material in a cylindrical shape either, with a bottom or without, as illustrated in the patent to Branscum, U.S. Pat. No. 4,372,453, has been used to keep a drink from absorbing the latent heat from the atmosphere around it. Users regarded this device not only as practical, but also as fashionable, if not "trendy." This device, although useful as an insulating device to keep a drink cold, is unable to achieve aerodynamic flight. Thus, it's attributes as a recreational device are minimal.

The flying cylinder has been around for many years. It's design has been flown and enjoyed by it's users for as long.

The basic design consists of a one-piece cylinder uniform about it's circumference, weighted uniformly about it's circumference at the forward end. The throwing toys in the patent to Morrow, U.S. Pat. No. 3,364,776, and the patent to Klahn and Upham, U.S. Pat. No. 4,151,674 are forms of this aerodynamic design. These devices although enjoyable and desirable as throwing toys and flying mechanisms are of little use as an insulator for a beverage.

Both of these devices have, singularly, been used and enjoyed to their maximum capabilities. Therefore, it follows that users would prefer getting the advantages of both the drink cooler and the flying cylinder in one device. This invention is that device.

OBJECTS AND ADVANTAGES

Accordingly I claim the following as my objects and advantages of the invention: to provide a device that can be used for both recreation and practicality, to provide a device that can keep a cold drink, cold, and even a hot drink hot, by insulating it against the neutralizing forces of it's surrounding environment, and provide it's user the comfortability of not having to hold a cold or hot drink directly against the skin, as well as to provide a throwing toy for fun and recreation when not in use as a drink cooler, and to provide a throwing toy with a wide variety of flight characteristics for the enjoyment of the user.

In addition I claim the following additional objects and advantages: to provide a device that can be thrown in a myriad of ways back and forth between people, producing enjoyment, while also being able to be slipped over their drink (i.e. can of soda,beer,etc.), to keep it cold, to provide a device that can keep a drink cold until it has been finished, and then slipped off the empty container to be used immediately in a game of catch, to provide a novel device that can singularly reproduce the advantages of both of the objects of prior art.

Readers will find further objects and advantages of the invention from a consideration of the ensuing description and the accompanying drawings.

DRAWING FIGURES

Figure 3A:
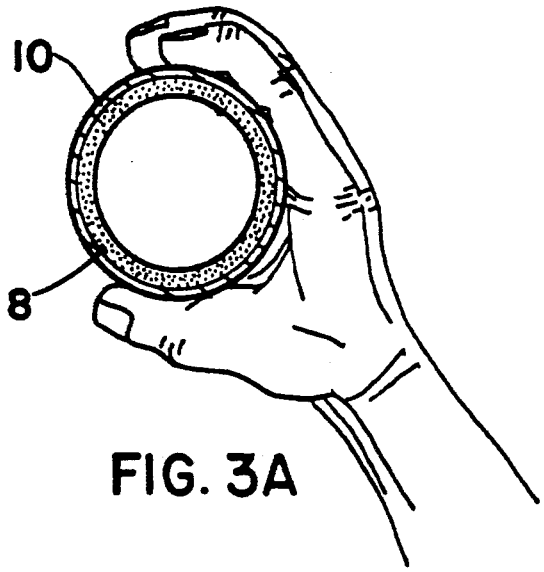
Figure 3B:
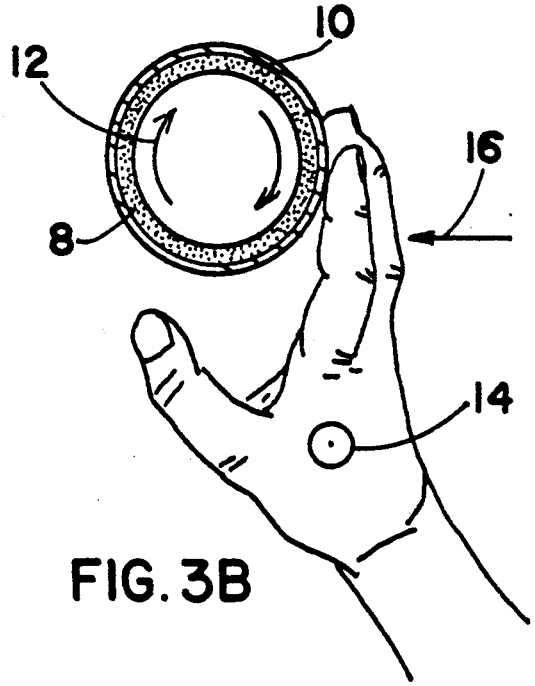

FIG. 3*a* and 3*b* shows a back side view of such device in use as a throwing toy.

Figure 4:
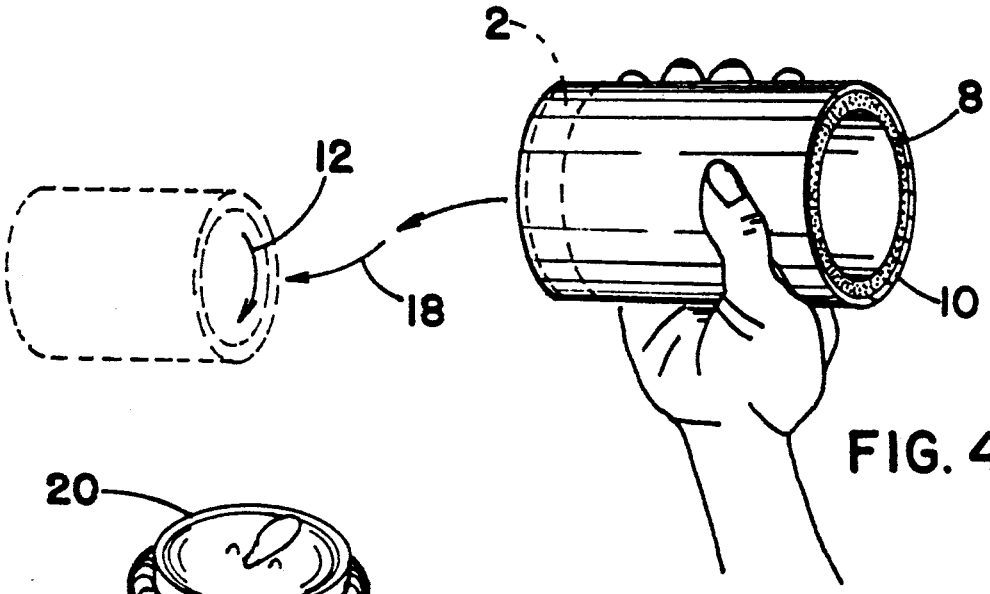

FIG. 4 shows a side view of such device in use as a throwing toy.

Figure 5:
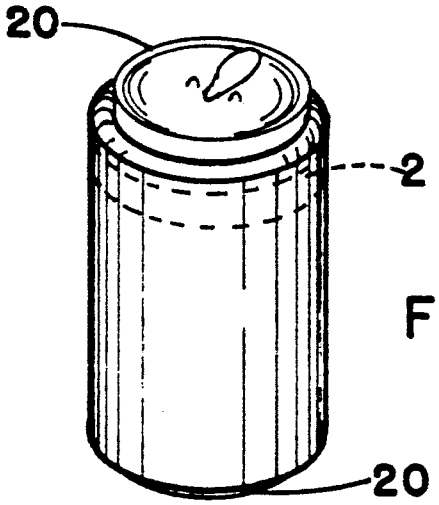

FIG. 5 shows a side view of such device in use as a drink cooler.

DRAWING REFERENCE NUMERALS

2 WEIGHTED RING
4 ROUNDED (SLIGHTLY TAPERED) REAR
6 ROUNDED FRONT
8 INNER CYLINDER
10 OUTER CYLINDER
12 AXIAL SPIN
14 MOVEMENT INTO THE BOARD
16 FLICK OF THE WRIST MOVEMENT
18 DIRECTION OF FLIGHT
20 BEVERAGE CONTAINER

SINGLE-PIECE DEVICE—-DESCRIPTION

The invention is a cylindrical device, open at both ends, designed to be slipped over a container of liquid as seen in FIG. 5. The body of the device is made up of two cylinders of material. The inner cylinder is of an insulating material, while the outer cylinder is made of a stiff, yet flexible composition material. A weighted ring is sandwiched between these two layers uniformly around the circumference of the forward end of the device. This ring provides the device with a forward center of gravity necessary to achieve aerodynamic stability while in flight. These features are best seen in FIGS. 1 and 2.

Figure 1:
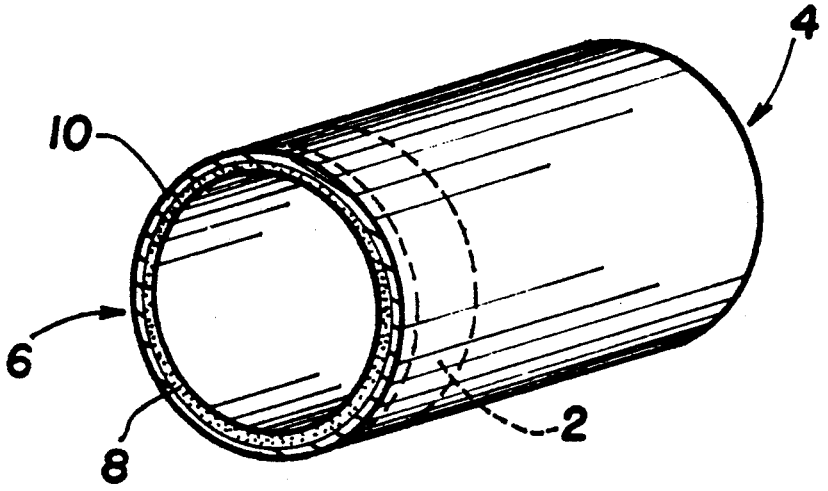
FIG. 1 shows a perspective forward elevation view of a one-piece device according to the invention.
Figure 2:
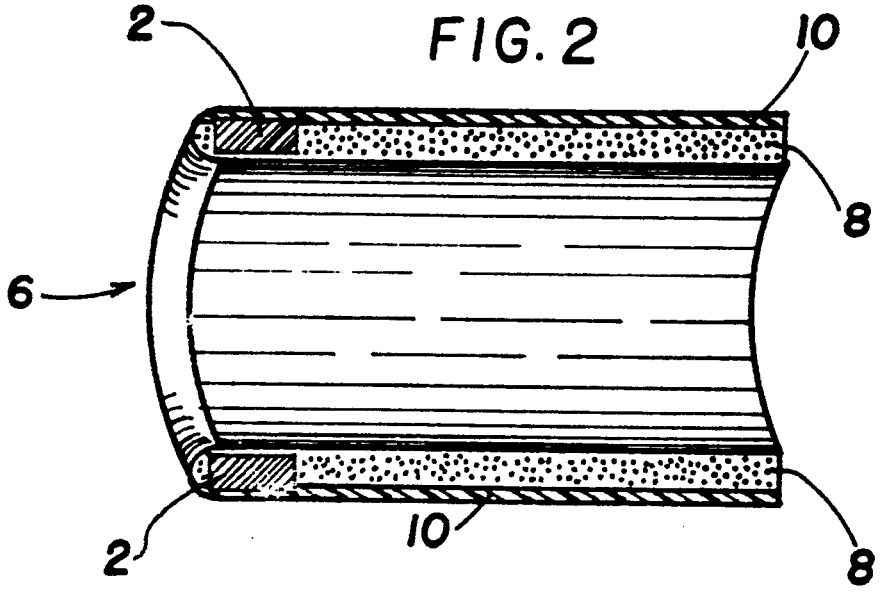
FIG. 2 shows a cross-section side view of such device taken along the line FIG. 2—FIG. 2 of FIG. 1.

FIG. 1 shows a single-piece device according to the preferred embodiment of the invention. The device comprises an inner cylinder 8 of a light insulating material of the kind used for diving suits, which is adhered to the inside surface of an outer cylinder 10, which is preferably made of a firm, yet flexible plastic/rubber composition. This outer cylinder provides a rigid exterior necessary for level and extended flight as a throwing toy. The forward portion of the device comprises the inner and outer cylinders mentioned above, as well as, a flexible, weighted ring 2 sandwiched between the two layers, just inside the rounded front 6 of the device. The weighted ring 2 provides forward mass and stability that are the necessary components to achieve a stable, aerodynamic flight of the flying cylinder concept.

FIG. 1 depicts a rounded front 6 and a slightly tapered rear 4. These are best seen in the horizontal cross-section in FIG. 2. The rounded front 6 provides for smoother airflow through and around the device, and a surface that is resistant to damage. The slightly tapered, rounded rear 4 of the device in FIG. 2 has the purpose of reducing airflow drag at the rear of the cylinder, while it is in flight as a throwing toy.

Though the basic aerodynamic design must be maintained in order for the device to fly, several different materials may be employed for construction of the body of the device. The weighted ring that provides aerodynamic stability should be flexible in the event the device is crushed, yet this is not necessary to produce the desired results of aerodynamic flight. The thickness of the cylinder wall is dependent on a relationship of the weight ratio between the body of the device and the weighted ring. The approximate thickness of the walls of both cylinders combined will be ¼ in. Durability should be inherent in the materials used.

SINGLE-PIECE DEVICE—OPERATION

The single-piece device shown in FIG. 1 will perform a dual purpose as a throwing toy and a drink cooler. For this first function, as a throwing toy, there are a great variety of ways and styles of using the invention.

To play a game of catch with this device, that is to throw it back and forth between two or more people, the user should slip the device off of the container of liquid that it was insulating, then the user should hold the device in such a way as to provide a rotation (axial spin) when the device is released. This can be accomplished in many ways. An example of one way to hold and throw the device can be seen in FIGS. 3A and 3B. FIG. 3A shows the device being held at rest in a typical throwing grip. FIG. 3B and FIG. 4 use directional arrows 12,14,16,18 to show motion as the device is released (three-D demarkation is used to show movement into the board 14). To accomplish a typical throw of the device the user will grip the device with the thumb opposing the fingers as seen in FIGS. 3A,3B, and FIG. 4, then, in the same fashion as throwing a football, with an overhand throwing motion release the device just past the apex of the arm swing. When rotation is provided to the device, through arm and wrist motion 16 as seen in FIG. 3B, it will spiral about it's horizontal axis 12 while in flight. This will provide, in combination with the weighted ring 2 in FIG. 1 aerodynamic stability, in other words, a smooth and calculatable flight.

This invention can be thrown in a myriad of ways. It can be thrown lefthanded or righthanded, overhand or underhand, straightarm or bentarm, behind the back, and even between the legs. Any person able to throw a football could easily acquire the skill to operate this device as a throwing toy. The average distance for a game of catch would be 80 ft., but it is possible for this device to sail twice this distance.

The second function of this device is as a drink cooler (an insulating device for keeping a drink cold). The insulating material in the inner cylinder 8 of the device in FIGS. 1 and 2, provides a barrier between the cold liquid in the container and the warming influences of the atmosphere around it. To operate this feature of the device the user should simply slip the device over a container of liquid (the primary design will function as a cooler for a drink the diameter and height of a standard soda can, roughly 2½ in. in diameter by 4⅞ in. tall) so that it covers the container to almost it's (the container's) full extent. This can be seen in FIG. 5.

CONCLUSION, RAMIFICATIONS, AND SCOPE OF THE INVENTION:

Thus, the reader will see that the flying drink cooler invention provides a novel, practical, and enjoyable device, which can be used by persons of almost any age.

While my description above contains many specfics, these should not be construed as limitations on the scope of the invention, but rather as an exemplification of one preferred embodiment thereof. There are other variations that are possible. For example flying drink coolers of varying diameters could be produced to accomodate containers of varying sizes, and, most importantly, the cooler could be used as an advertising medium for brands of drinks. Accordingly, the scope of the invention should be determined not by the embodiment illustrated, but by the appended claims and their legal equivalents.

I claim:

1. A combination drink cooler and throwing toy for use as a device for insulating a container of liquid, as well as, a device for use as a throwing toy, comprising:

an open-ended inner cylinder means of an insulating material for insulating a container of liquid from it's surrounding environment, and an open-ended outer cylinder means for stability in flight, wherein said inner cylinder being joined about it's outer surface to inside of said outer cylinder, and a weighted ring means for providing forward mass necessary for aerodynamic flight encircling the forward end of the device sandwiched between said inner cylinder and said outer cylinder.

2. The combination drink cooler and throwing toy of claim 1 wherein said inner cylinder is made of foam rubber.

3. The combination drink cooler and throwing toy of claim 1 wherein said outer cylinder is made of a rigid, yet flexible plastic composition.

4. The combination drink cooler and throwing toy of claim 1 wherein said inner cylinder is glued with a waterproof adhesive to the inside surface of said outer cylinder.

5. The combination drink cooler and throwing toy of claim 1 wherein said weighted ring is made of a dense rubber/plastic composite means so that said weighted ring can withstand rough handling.

6. The invention of claim 1 wherein said inner cylinder and said outer cylinder are of the same length.

7. The invention of claim 1, further including a rounded front edge and a rounded, slightly tapered rear edge.

* * * * *